US008637218B2

(12) United States Patent
Sakata et al.

(10) Patent No.: US 8,637,218 B2
(45) Date of Patent: Jan. 28, 2014

(54) CARRIER FOR DEVELOPING ELECTROSTATIC LATENT IMAGE AND DEVELOPER

(75) Inventors: Koichi Sakata, Shizuoka (JP); Shigenori Yaguchi, Shizuoka (JP); Kimitoshi Yamaguchi, Shizuoka (JP); Toyoshi Sawada, Kanagawa (JP); Hiroshi Tohmatsu, Shizuoka (JP); Hiroyuki Kishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/556,549

(22) Filed: Jul. 24, 2012

(65) Prior Publication Data

US 2013/0065175 A1 Mar. 14, 2013

(30) Foreign Application Priority Data

Sep. 14, 2011 (JP) ..... 2011-200223

(51) Int. Cl.
*G03G 9/113* (2006.01)

(52) U.S. Cl.
USPC ..... 430/114; 430/113.5

(58) Field of Classification Search
USPC ..... 430/111.35, 111.4
See application file for complete search history.

(56) References Cited

U.S. PATENT DOCUMENTS

| | | | | |
|---|---|---|---|---|
| 5,832,350 | A | 11/1998 | Kumasaka et al. | |
| 2008/0038653 | A1* | 2/2008 | Yamazaki et al. | 430/106.2 |
| 2008/0199799 | A1* | 8/2008 | Tsurumi et al. | 430/110.2 |
| 2008/0227004 | A1 | 9/2008 | Yamaguchi et al. | |
| 2010/0233613 | A1 | 9/2010 | Masuda et al. | |
| 2010/0239975 | A1 | 9/2010 | Yamaguchi et al. | |
| 2011/0065037 | A1 | 3/2011 | Iwatsuki et al. | |
| 2011/0086307 | A1 | 4/2011 | Nakajima et al. | |
| 2011/0091802 | A1* | 4/2011 | Takahashi et al. | 430/108.3 |
| 2011/0171573 | A1 | 7/2011 | Sakata et al. | |
| 2011/0217649 | A1 | 9/2011 | Masuda et al. | |
| 2011/0229817 | A1 | 9/2011 | Yamada et al. | |
| 2012/0009514 | A1 | 1/2012 | Nagayama et al. | |
| 2012/0009518 | A1 | 1/2012 | Nagayama et al. | |
| 2012/0028183 | A1 | 2/2012 | Nakajima et al. | |
| 2012/0057898 | A1 | 3/2012 | Sakata et al. | |
| 2012/0058423 | A1 | 3/2012 | Yamaguchi et al. | |
| 2012/0064451 | A1 | 3/2012 | Kishida et al. | |

FOREIGN PATENT DOCUMENTS

| | | |
|---|---|---|
| JP | 6-92813 | 4/1994 |
| JP | 7-72733 | 3/1995 |
| JP | 7-92813 | 4/1995 |
| JP | 7-128983 | 5/1995 |
| JP | 7-261464 | 10/1995 |
| JP | 9-251237 | 9/1997 |
| JP | 11-065247 | 3/1999 |
| JP | 11-231652 | 8/1999 |

(Continued)

*Primary Examiner* — Peter Vajda
(74) *Attorney, Agent, or Firm* — Oblon, Spivak, McClelland, Maier & Neustadt, L.L.P.

(57) ABSTRACT

A carrier for developing electrostatic latent image, including a core material; and a coated layer covering the core material, including a binder resin and a particulate material, wherein the core material is exposed on the surface of the carrier at an areal ratio of from 0.1 to 5.0% and has the largest exposed part having an areal ratio not greater than 0.03%, and wherein the coated layer comprises the particulate material in an amount of from 100 to 500 parts by weight per 100 parts by weight of the binder resin.

11 Claims, 3 Drawing Sheets

(56) References Cited

FOREIGN PATENT DOCUMENTS

| | | |
|---|---|---|
| JP | 11-295934 | 10/1999 |
| JP | 2001-134019 | 5/2001 |
| JP | 2003-131436 | 5/2003 |
| JP | 2003-167390 | 6/2003 |
| JP | 2005-157002 | 6/2005 |
| JP | 2008-203624 | 9/2008 |
| JP | 2009-109814 | 5/2009 |
| JP | 2009-151045 | 7/2009 |
| JP | 2009-180820 | 8/2009 |
| JP | 2009-258384 | 11/2009 |
| JP | 2010-256759 | 11/2010 |

* cited by examiner

CARRIER FOR DEVELOPING ELECTROSTATIC LATENT IMAGE AND DEVELOPER

CROSS-REFERENCE TO RELATED APPLICATIONS

This patent application is based on and claims priority pursuant to 35 U.S.C. §119 to Japanese Patent Application No. 2011-200223 filed on Sep. 14, 2011 in the Japanese Patent Office, the entire disclosure of which is hereby incorporated herein by reference.

FIELD OF THE INVENTION

The present invention relates to a carrier used for developing an electrostatic latent image in electrophotography, electrostatic recording, electrostatic printing, etc., a developer, an image forming method using the developer, a container containing the developer, a process cartridge, a refill developer and an image forming apparatus.

BACKGROUND OF THE INVENTION

In electrophotographic image formation, an electrostatic latent image is formed on a photoconductive image bearer, a charged toner is attached to the electrostatic latent image to form a visual toner image, the toner image is transferred onto a recording medium such as a paper and fixed thereon. Recently, electrophotographic copiers and printers have rapidly developed from monochrome to full-color, and the full-color market is expanding.

Electrophotographic full-color image formation typically uses three primary colors yellow, magenta and cyan toners or four color toners including a black toner, adjusts contrasting density of each color toner image and overlaps each of the color toner images to reproduce all colors. However, occasionally a following image takes over a history of the last image (ghost phenomenon), and when a toner image varies in density, the resultant image varies in color toner.

Conventionally, a one-component developing method, a two-component developing method and a hybrid developing methods are used, and each of the methods is thought to have a different occurrence mechanism of the ghost phenomenon from each other.

Namely, in the one-component developing methods, when a residual toner unconsumed in the developing process returns in the image developer, the toner is not completely scraped off from the feed roller and remains on the surface of the developing roller to be used in the following development. The residual toner is mechanically scraped off at a toner feeding part and the toner having a large particle diameter is relatively easy to scrape off and the toner having a small particle diameter gathers at a developing part, and which causes a specific charge variation, resulting in the ghost phenomenon.

The hybrid developing method forms a magnetic brush formed of a non-magnetic toner and a magnetic carrier on the outer circumference of a magnetic roller, feeds only the non-magnetic toner to a toner bearer from the magnetic roller to form a uniform toner layer, and applies the toner of the toner layer to an electrostatic latent image on an image bearer. A specific amount of the toner is constantly fed to the toner bearer and the toner amount thereon is varied due to the last image, resulting in the ghost phenomenon.

Namely, when the last image consumes less toner, the toner remains more on the toner bearer, and the toner thereon further increases after the toner is fed and the resultant image has higher density. Meanwhile, after an image consuming more toner is produced, the toner remaining on the toner bearer decreases. The toner amount on the toner bearer is relatively less after the toner is fed and the resultant image has lower density.

As mentioned above, the ghost phenomenon in the hybrid developing method is caused by the toner amount variation on the toner bearer when a following image is produced according to the history of the last image because it is difficult to uniform the amount of the decreased toner after used for development and the amount of the undeveloped toner remaining on the toner bearer when the toner is transferred onto the toner bearer from the magnetic brush.

In order to solve these problems, Japanese Patent No. 3356948, and Japanese published unexamined applications Nos. 2005-157002 and 11-231652 disclose scraping off the toner remaining on the toner bearer therefrom with a scraper or a toner collection roller after developed and before fed again. Japanese published unexamined application No. 7-72733 discloses a method of collecting the toner remaining on the toner bearer on a magnetic roller by potential difference between copyings or papers to stabilize the toner amount on the toner bearer. Further, in order to solve the problem of history development using the magnetic brush, Japanese published unexamined application No. 7-128983 discloses widening a half width area of a magnetic flux density of the magnetic roll to collect and feed the toner on the toner bearer. Japanese published unexamined application No. 6-92813 discloses a method of using a non-spherical carrier to increase the surface area thereof and increasing a ratio of the carriers contacting each other to charge the carrier even at the end of the magnetic brush, narrowing a substantial gap between the developer bearer and the toner bearer to increase the toner amount fed to the toner bearer at a time, and feeding the toner until the toner bearer is saturated with the toner to maintain a specific amount of the toner on the toner bearer and prevent an influence of the last image history.

Even the two-component developing method has the ghost phenomenon. Poor separation of the developer is thought to cause the ghost phenomenon.

The two-component developing method has an odd number of magnets in the developer hearer and a pair of magnets having the same polarity below the rotational axis of the developing sleeve to form a separation area where a magnetic force is almost zero. The developer naturally falls there by gravity to separate from the developer bearer.

However, the carrier has a counter charge when the toner is consumed in the last image, and an image force generates between the carrier and the developer bearer and the developer does not separate at the separation area. The toner is consumed and the developer having a lowered toner concentration is fed to the developing area again, resulting in production of images having low image density. Namely, images having normal image density are produced for one cycle of the sleeve, but the image density lowers since the second cycle, resulting in the ghost phenomenon.

In order to solve these problems, Japanese published unexamined application No. 11-65247 discloses a configuration of locating a scoop roll having a magnet inside at the separation area above the developer bearer to separate the developer after developed by the magnetic force. The separated developer is further scooped up by another scoop roll, and fed to a developer stirring chamber where the toner concentration is adjusted again and the toner is charged.

However, even when the toner concentration is adjusted again and the toner is charged, the ghost phenomenon occasionally occurs. The mechanism of this ghost phenomenon is not clarified, but it is thought the toner adhered to the developer bearer according to the last image history and the toner amount developing the following image varies according to a potential of the toner having adhered to the developer bearer.

Specifically, the toner adheres to the developer bearer because a bias is applied in a direction of the developer bearer in a non-image forming area and the toner in the development area is developed on the developer bearer. Having a potential, the toner developed on the toner bearer increases the development potential on the part where the toner is developed, resulting in increase of the toner amount for development.

Meanwhile, a carrier capable of stably forming images against potential or environmental variation is studied.

Japanese Patent No. 3755289 discloses a carrier including a specific metallic atoms such as iron, an alkali metal or an alkali earth metal in its silicone-resin coated layer to induce a charge accumulated on the surface inside to prevent accumulation of the charge on the surface. However, the metallic atoms independently present in the silicone-resin coated layer do not sufficiently induce the charge.

Japanese published unexamined applications Nos. 2010-256759 and 2009-109814 and Japanese Patent No. 3298034 disclose a resin-coated carrier exposing its core material on the surface at a specific ratio. However, a size of one of the exposed parts of the core material is not disclosed. When an area of the exposed part of the core material is large, the carrier is vulnerable to moisture and a charge is easy to leak.

Japanese Patent No. 3904205 discloses an average area ratio of one of the exposed parts of the core material not greater than 0.03%. However, the resin-coated carrier exposing its core material on the surface has thin layer thickness around the exposed part and the exposed part is vulnerable to stress, resulting in deterioration of durability.

Japanese published unexamined applications Nos. 2009-180820 and 2008-203624 disclose a resin-coated carrier, the resin layer of which includes an electroconductive particulate material to control resistivity of the resin layer. However, the resin layer does not have sufficient durability.

Because of these reasons, a need exist for a carrier having good durability, consuming a stable amount of a toner for development without influence of the toner consumption history of the last image, and producing uniform images having good color reproducibility for long periods.

SUMMARY OF THE INVENTION

Accordingly, one object of the present invention to provide a carrier having good durability, consuming a stable amount of a toner for development without influence of the toner consumption history of the last image, and producing uniform images having good color reproducibility for long periods.

Another object of the present invention to provide a two-component developer using the carrier.

These objects and other objects of the present invention, either individually or collectively, have been satisfied by the discovery of a carrier for developing electrostatic latent image, comprising:

a core material; and a coated layer covering the core material, comprising a binder resin and a particulate material, wherein the core material is exposed on the surface of the carrier at an areal ratio of from 0.1 to 5.0% and has the largest exposed part having an areal ratio not greater than 0.03%, and wherein the coated layer comprises the particulate material in an amount of from 100 to 500 parts by weight per 100 parts by weight of the binder resin.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
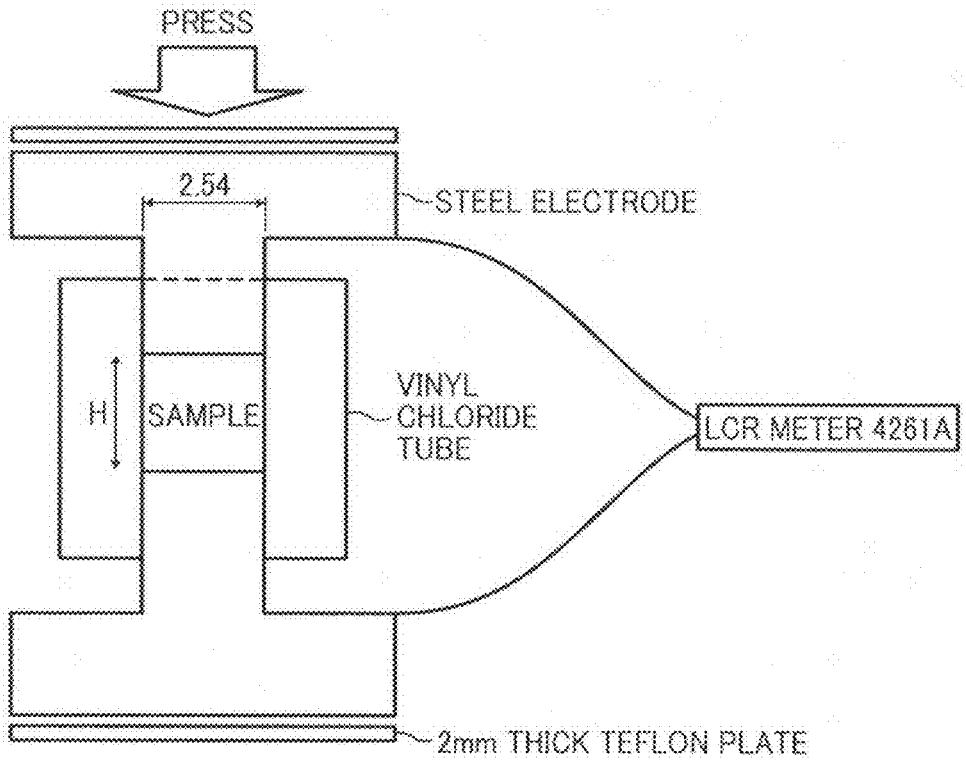
FIG. 1 is a schematic view illustrating a method of measuring a resistivity of a powder.

The present invention provides a carrier having good durability, consuming a stable amount of a toner for development without influence of the toner consumption history of the last image, and producing uniform images having good color reproducibility for long periods.

More particularly, the present invention relates to a carrier for developing electrostatic latent image, comprising:

a core material; and a coated layer covering the core material, comprising a binder resin and a particulate material, wherein the core material is exposed on the surface of the carrier at an areal ratio of from 0.1 to 5.0% and has the largest exposed part having an areal ratio not greater than 0.03%, and wherein the coated layer comprises the particulate material in an amount of from 100 to 500 parts by weight per 100 parts by weight of the binder resin.

The coated layer does not completely cover the surface of the core material and has a part where the core material is exposed.

The core material is exposed on the surface of the carrier at an areal ratio of from 0.1 to 5.0%, and preferably from 0.1 to 2.0%.

When less than 0.1%, a toner developed on the developer bearer is consumed in printing. When greater than 5.0%, a toner developed on non-image areas increases, resulting in deterioration of image uniformity.

Further, the core material has the largest exposed part having an areal ratio not greater than 0.03%, and preferably not greater than 0.01%.

When greater than 0.03%, a charge leak circuit is easy to form and a toner of non-image areas developed on the developer bearer increases, resulting in deterioration of image uniformity.

The areal ratios of the exposed core material and the largest exposed part thereof are measured by the following method. In the present invention, randomly selected 100 carriers are measured respectively and averaged.

A reflection electron image is photographed at an application voltage of 1 KV and a magnification 1,000 using a SEM S-4200 from Hitachi. Ltd. The picture is taken in a TIFF image to form an image including only a carrier using Image-Pro Plus from Media Cybernetics, Inc. The image is digitalized to separate a white part (core material exposed part) from a black part (resin-coated part) and areas thereof are measured to determine the areal ratio of the exposed core material.

Further, an area of the largest white part is measured to determine the areal ratio of the largest exposed part of the core material by the following formula.

The areal ratio of the exposed core material (%)= [White part area/(White part area+Black part area)]×100

The areal ratio of the largest exposed part (%)= [The largest white part area/(White part area+ Black part area)]×100

(Coated Layer)

The coated layer exposing the core material on the surface has thin layer thickness around the exposed part and the exposed part is vulnerable to stress, and the coated layer is required to have high strength and adhesiveness to the core material.

The coated layer includes the particulate material in an amount of from 100 to 500 parts by weight, preferably from 100 to 300 parts by weight per 100 parts by weight of the binder resin. When less than 100 parts by weight, the coated layer deteriorates in strength and is abraded to have lower resistivity, resulting in deterioration of image uniformity and worsening of carrier scattering when an image having a high image areal ratio is produced. When greater than 500 parts by weight, the particulate material is too many to the resin to hold the particulate material and the coated layer becomes fragile, resulting in deterioration of resistivity and image uniformity.

The particulate material is preferably an electroconductive particulate material. The electroconductive particulate material can control the carrier resistivity in addition to the filler effect. The electroconductive particulate material preferably has a volume-average particle diameter of from 100 to 700 nm. When less than 100 nm, the resin and the electroconductive particulate material are easy to adhere to the part exposing the core material and it is difficult to expose the core material. When greater than 700 nm, the particulate material is difficult to hold and the coated layer is abraded, resulting in deterioration of resistivity and image uniformity.

The volume-average particle diameter of the electroconductive particulate material is measured by an automatic particle size distribution analyzer, CAPA-700 (manufactured by Horiba, Ltd.). As a pretreatment for measurement, in a juice mixer, 30 ml of aminosilane (SH6020: manufactured by Toray Dow Corning Silicone Co., Ltd.) and 300 ml of a toluene solution are put. To the mixer, 6.0 g of a sample is added, the rotation speed of the mixer is set "low", and the sample is dispersed for 3 minutes. In 500 ml of a toluene solution previously prepared in a 1,000 ml-beaker, an appropriate amount of the dispersion liquid is added for dilution. The diluted liquid is continuously stirred in a homogenizer. This diluted solution is subjected to measurement by an automatic particle size distribution analyzer of ultracentrifugal type, CAPA-700.

Rotational speed: 2,000 rpm
Maximum particle size: 2.0 μm
Minimum particle size: 0.1 μm
Interval of particle size: 0.1 μm
Viscosity of dispersion medium: 0.59 mPa·S
Density of dispersion medium: 0.87 g/cm$^3$
Density of particles: for the density of barium sulfate, an absolute specific density value measured using a dry automatic high-density meter, Accupyc 1330 (manufactured by Shimadzu Corporation) is input.

The electroconductive particulate material preferably has a powder resistivity not greater than 2 (Log Ω·cm). When greater than 2, it is occasionally difficult to sufficiently control the resistivity of the carrier.

The powder resistivity is measured by the following method (FIG. 1). Five (5) g of a sample is weighed by a scale balance, a steel electrode is contacted to the bottom of a vinyl chloride tube having an inner diameter of 1 inch, and the sample is placed in the vinyl chloride tube. Next, a steel electrode is contacted to the top of the vinyl chloride tube as well. A TEFLON (registered mark) plate 2 mm thick is placed on the top and bottom of the electrode, and a pressure of 10kg/cm$^2$ is applied to the sample by a hydraulic machine. While pressed at 10kg/cm$^2$, an LCR meter (4261A from Yokokawa Hewlett-Packard Co. or a measurer having a capacity equivalent thereto or more) is connected to the sample. The resistivity r (Ω) right after the LCR meter is connected is measured and an entire length L (cm) of the sample is measured by a caliper to determine the powder resistivity (Ω·cm) by the following formula.

Powder resistivity (Ω·cm)=[(2.54/2)2×π$J$×$r$/($L$−11.35)]

wherein r represents a resistivity r (Ω) right after the LCR meter is connected, L represents an entire length when a sample is filled, and 11.35 represents an entire length when a sample is not filled.

Specific examples of the electroconductive particulate material include, but are not limited to, electroconductive polymers such as carbon black, ITO, tin oxide, barium sulfate, zinc oxide, titanium oxide, tin oxide without antimony, aluminum oxide and polyaniline. These can be used alone or in combination.

Adjustment of the resistivity of a carrier has been required in terms of image quality. When the resistivity of a carrier is not sufficiently adjusted, a charge leak speed is low and a counter charge generated on the carrier after development leaks slow. Therefore, the carrier deteriorates in chargeability to a new toner and an uncharged toner increases, frequently resulting in toner scattering on non-image areas. Or, the counter charge generated on the carrier after development causes an image force on the sleeve, and the developer to be separated from the sleeve clings thereto. The developer having less toner after development and the developer before consuming a toner are mixed, resulting in production of images having uneven image density. Uneven image density noticeably appears particularly in images having more printed images such as solid images. The carrier including $In_2O_3$ doped $Al_2O_3$/Sn and tin oxide without antimony is not only more effectively adjusted in resistivity but also quick in leaking charge. Therefore, the carrier has high chargeability to a new toner to prevent the toner from scattering, and the developer does not cling to the sleeve to produce uniform images without uneven image density.

The binder resin in the coated layer preferably includes at least a silicone resin. This is because the silicone resin has a low surface energy, and toner spent is difficult to occur or accumulate.

Specific examples of the silicone resin include, but are not limited to, any known silicone resins such as straight silicones formed only of organosiloxane bonds and silicones modified with a resin such as an alkyd resin, a polyester resin, an epoxy resin, an acrylic resin and a urethane resin.

Specific examples of marketed products of the straight silicones include, but are not limited to, KR271, KR255 and KR152 from Shin-Etsu Chemical Co., Ltd; and SR2400, SR2406 and SR2410 from Dow Corning Toray Silicone Co., Ltd. The straight silicone resins can be used alone, and a combination with other constituents crosslinking therewith or charge controlling constituents can also be used. Specific examples of the modified silicones include, but are not limited to, KR206 (alkyd-modified), KR5208 (acrylic-modified), EX1001N (epoxy-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

The coated layer of the present invention preferably includes a resin obtained by heating a copolymer including an A site from a monomer A component and a B site from a monomer B component having the following formulae (1) and (2), respectively:

(1)

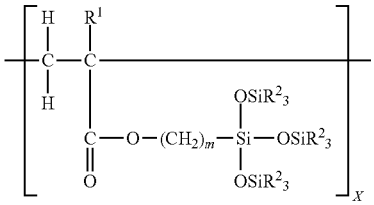

A site (from monomer A component)

(2)

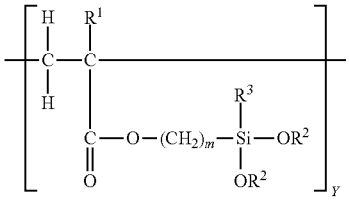

B site (from monomer B component)

wherein $R^1$ represents a hydrogen atom or a methyl group; m represents an alkylene group having 1 to 8 carbon atoms; $R^2$ represents an alkyl group having 1 to 4 carbon atoms; $R^3$ represents an alkyl group having 1 to 8 carbon atoms or an alkoxy group having 1 to 4 carbon atoms; X represents 10 to 90% by mol; and Y represents 10 to 90% by mol.

Including the monomer A component having tris(trimethylsiloxy)silane and the monomer B component having a radical polymerizable di- or trifunctional silane compound, the above-mentioned resin has low surface energy, decrease adherence of a resin or a wax of a toner, and improves toughness of the layer.

Further, the coated layer preferably includes a C component (and monomer C component) having the following formula (3):

(3)

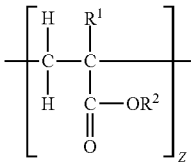

wherein $R^1$ represents a hydrogen atom or a methyl group; $R^2$ represents an alkyl group having 1 to 4 carbon atoms; and Z represents 10 to 90% by mol.

The coated layer including the above-mentioned resin is prepared by hydrolyzing a copolymer obtained by radically copolymerizing the monomer A component and the monomer B component or the monomer C component in addition thereto to form a silanol group, condensing the silanol group using a catalyst such that the copolymer is crosslinked, coating the core material with the crosslinked copolymer, and heating the coated copolymer.

Methods of condensing the silanol group while coating the core material with a composition for resin layer are not particularly limited, and a method of coating the core material with a composition for resin layer while applying a heat and light thereto, etc. can be used. Methods of condensing the silanol group after coating the core material with a composition for resin layer are not particularly limited, a method of heating the coated layer after coating the core material with a composition for resin layer, etc. can be used.

When the content of the A component is less than 10% by mol, the surface energy does not sufficiently lower and toner adherence quickly increases. When greater than 90% by mol, the component B and the component C decreases, the coated layer is not well crosslinked and does not have enough toughness, and adhesiveness between the core material and the coated later deteriorates, resulting poor durability of the coated layer of the carrier.

$R^2$ represents an alkyl group having 1 to 4 carbon atoms in the formula (1). Such monomer components include tris(trialkylsiloxy)silane compounds having the following formulae:

$CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4H_8{-}Si(OSiPr_3)_3$ wherein Me represents a methyl group; Et represents an ethyl group and Pr represents a propyl group.

Methods of preparing the A component are not particularly limited, and a method of reacting tris(trialkylsiloxy)silane with allyl acrylate or allyl methacrylate under the presence of a platinum catalyst, a method of reacting methacryloxy alkyl trialkoxy silane with hexaalkyldisiloxane under the presence of a carboxylic acid and an acid catalyst, disclosed in Japanese published unexamined application No. 11-217389, etc. can be used.

The content of the B component is 10 to 90% by mol, and preferably from 30 to 70% by mol. When less than 10% by mol, the coated layer has a few crosslinked points and does not have enough toughness. When greater than 90% by mol, the coated layer is hard and fragile, and easy to abrade. Further, hydrolyzed crosslinking components remaining in a large amount as a silanol group are thought to deteriorate moisture resistance of the coated layer.

Specific examples of the B component include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane and 3-acryloxypropyltri(isopropoxy)silane.

As the contents of the A component and the B component when the C component is included, X=10 to 40% by mol, Y=10 to 40% by mol and Z=30 to 80% by mol, and preferably 35 to 75% by mol, and 60% by mol<Y+Z<90% by mol, and preferably 70% by mol<Y+Z<85% by mol.

When the C component is greater than 80% by mol, Y or Y is less than 10, the coated layer is difficult to have repellency, hardness and flexibility. When less than 30% by mol, the coated layer does not occasionally have sufficient adhesiveness.

As the C component, acrylate and methacrylate are preferably used, specifically including methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino)ethyl methacrylate and 2-(diethylamino)ethyl acrylate. Among these, alkyl methacrylate is preferably used, particularly, methyl methacrylate is more preferably used. These compounds may be used alone or in combination.

As a technique enhancing durability by crosslink of coating, there is one described in Japanese Patent No. 3691115. Namely, in regard to the one described in Japanese Patent No. 3691115 specification, it is a carrier for an electrostatic image development characterized by coating the surface of magnetic particle with a thermosetting resin that a copolymer of an organopolysiloxane having at least a vinyl group at the end and a radical copolymerizable monomer having at least one functional group selected from the group consisting of hydroxyl group, amino group, amide group and imide group is cross-linked by an isocyanate compound, but the actual situation is that no sufficient durability on peeling and scraping of coating is obtained.

Although the reason has been not cleared sufficiently, in the case of thermosetting resin that the foregoing copolymer is cross-linked by an isocyanate compound, as is known from the structural formula, functional groups (active hydrogen-containing groups) per unit weight reacting (cross-linking) an isocyanate compound in a copolymer resin are too few to form a two-dimensionally or three-dimensionally dense crosslink structure at a crosslink point. Therefore, it is inferred that in a prolonged use, peeling and scraping of coating occur easily (abrasion resistance of coating is poor), so a sufficient durability is not obtained.

When peeling and scraping of coating occur, change of image quality due to the lowering of carrier resistance and carrier adhesion take place. Peeling and scraping of coating deteriorates flow properties of developer, leading to the lowering of amount scooped, and causing the lowering of image concentration, background fouling due to TC up, and scattering of toner.

In the present invention, it uses a copolymer resin having a lot of functional groups (points) capable of cross-linking being difunctional or trifunctional per resin unit weight (per unit weight, as many as 2 to 3 times), and this is further cross-linked by condensation polymerization, hence it is thought that coating is very tough and hardly scraped, leading to high durability.

Compared with crosslink by an isocyanate compound, crosslink by siloxane bond in the present invention is larger in bond energy and more stable to heat stress, hence it is inferred that stability of coating with time is maintained.

The coated layer of the present invention preferably include a silane coupling agent further in order to stabilize the carrier and improve durability thereof.

The silane coupling agents are not particularly limited, and methyltrimethoxysilane, methyltriethoxysilane, octyltrimethoxysilane, etc. can be used. Aminosilane is preferably used.

Known aminosilane coupling agents can be used, e.g., compounds having the following formulae are preferably used.

$H_2N(CH_2)_3Si(OCH_3)_3$ $H_2N(CH_2)_3Si(OC_2H_5)_3$ $H_2N(CH_2)_3Si(CH_3)_2(OC_2H_5)$ $H_2N(CH_2)_3Si(CH_3)(OC_2H_5)_2$ $H_2N(CH_2)_2NHCH_2Si(OCH_3)_3$ $H_2N(CH_2)_2NH(CH_2)_3Si(CH_3)_2(OCH_3)$ $H_2N(CH_2)_2NH(CH_2)_3Si(OCH_3)_3$ $(CH_3)_2N(CH_2)_3Si(CH_3)(OC_2H_5)_2$ $(C4H_9)_2NC_3H_6)_3Si(OCH_3)_3$

The aminosilane coupling agent is preferably included in the coated layer in an amount of from 0.001 to 30% by weight, and more preferably from 0.001 to 10% by weight. When less than 0.001% by weight, the carrier occasionally does not improve in durability. When greater than 30% by weight, the coated layer is occasionally difficult to hold an electroconductive or an inorganic particulate material inside.

The areal ratio of the exposed core material is controlled by the thickness of the coated layer, the viscosity of the coated layer forming composition, etc.

The coated layer preferably has a thickness of from 0.1 to 1 μm, although depending the resin or the surface convexities and concavities of the core material.

Specific examples of the core material include, but are not limited to, known materials for electrophotographic two-component developer such as ferrite, Cu—Zn ferrite, Mn ferrite, Mn—Mg ferrite, Mn—Mg—Sr ferrite, magnetite, iron and nickel.

The core material preferably has shape factors SF-1 of from 130 to 150, and SF-2 of from 130 to 160. When SF-2 is too small, the surface convexities and concavities of the core material are too small to expose the core material, and the coated layer becomes so thin that the carrier deteriorates in durability. The shape of the core material is controlled by burning time and temperature.

The shape factors SF-1 and SF-2 are determined in accordance with the following formulae:

$$SF\text{-}1=\{(MXLNG)^2/AREA\}\times(100\pi/4)$$

wherein MXLNG represents an absolute maximum length of a toner on an image and AREA represents a projected area thereof.

$$SF\text{-}2=\{(PERIME)^2/AREA\}\times(100\pi/4)$$

wherein PERIME represents a peripheral length of a projection image of a toner and AREA represents a projected area thereof.

The shape factor SF-1 represents a degree of roundness of a toner. When the SF-1 is 100, the toner has the shape of a complete sphere. As SF-1 becomes greater, the toner becomes more amorphous. SF-2 represents the concavity and convexity of the shape of the toner. When SF-2 is 100, the surface of the toner has less concavities and convexities. As SF-2 becomes greater, the concavities and convexities thereon become larger.

The core material of the present invention preferably has SF-2 larger than SF-1. When SF-1 is larger than SF-2, the shape of the carrier has an influence larger than that of the exposed part of the core material due to the surface convexities and concavities thereof, and a local resistivity is not effectively controlled.

SF-1 and SF-2 are determined by randomly photographing 100 particles of a sample with an FE-SEM (S-800) from Hitachi, Ltd. at a magnification of 300 times and analyzing the photographed image with an image analyzer Luzex AP from NIRECO Corp through an interface.

The carrier of the present invention preferably has a weight-average particle diameter of from 20 to 65 μm, and more preferably less than 40 μm.

This noticeably improves carrier adherence and image quality.

When less than 20 μm, the carrier deteriorates in uniformity, image forming apparatuses capable of using the carrier are not available, and carrier adherence occurs. When greater than 65 μm, reproducibility of image detail deteriorates and high-definition images are not produced.

The weight-average particle diameter of the carrier is measured by a micro-track particle size distribution meter SRA type (manufactured by Nikkiso Co., Ltd.) in a range of from 0.7 to 125 μm. Methanol is used as a solvent for a dispersion for use in the measurement, and the carrier and the core materials have a refraction index of 2.42.

The carrier of the present invention preferably has a volume resistivity of from $1\times10^{8}$ Ω·cm to $1\times10^{15}$ Ω·cm, and more preferably from $1\times10^{8}$ Ω·cm to $1\times10^{12}$ Ω·cm. When less than $1\times10^{8}$ Ω·cm, the toner amount developed on the developer bearer increases and the resultant images do not have uniformity. When greater than $1\times10^{15}$ Ω·cm, the toner developed on the developer bearer is consumed in printing and the resultant images do not have uniformity.

Figure 2:
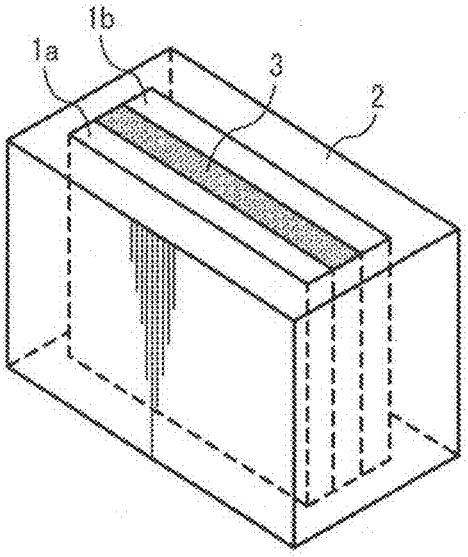
FIG. 2 is a schematic view illustrating a cell used for measuring a specific volume resistivity of a carrier.

The volume resistivity can be measured by using a cell shown in FIG. 2. Specifically, first, in a cell composed of a fluorine resin container (2) where an electrode (1a) and electrode (1b) of surface area 2.5 cm×4 cm are accommodated at a distance of 0.2 cm, a carrier (3) is filled, and tapped for 1 min at a tapping speed of 30 times/min by PTM-1 from SANKYO PIO-TECH. CO., Ltd. Next, direct voltage of 1000 V was applied between the electrodes (1a) and (1b), and a DC resistance is measured by a high resistance meter 4329A (4329A+ LJK5HVLVEDQFH OHWHU) from YOKOKAWA HEWLETT PACKARD LTD to determine an electric resistance R Ω·cm and Log R.

When the volume resistivity is below measureable lower limit of the high resistance meter, the volume resistivity is not substantially measured and regarded as a breakdown.

Known binder resins can be used as the binder resin for use in the toner of the present invention. Specific examples of the binder resin include, but are not limited to, styrene and its derivative such as polystyrene, poly(p-styrene) and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleate copolymers; polymethylmethacrylate, polybutylmethacrylate, polyvinylchloride, polyvinyl acetate, polyethylene, polyester, polyurethane, epoxy resins, polyvinyl butyral, polyacrylic acid, rosin, modified rosin, terpene resins, phenolic resins, aliphatic or aromatic hydrocarbon resins, aromatic petroleum resins, etc. These can be used alone or in combination.

Known binder resins can be used as pressure-fixing binder resins. Specific examples of the binder resin include, but are not limited to, polyolefin such as low-molecular weight polyethylene and low-molecular weight polypropylene; olefin copolymers such as ethylene-acrylic acid copolymers, ethylene-acrylate copolymers, styrene-methacrylic acid copolymers, ethylene-methacrylate copolymers, ethylene-vinyl chloride copolymers, ethylene-vinyl acetate copolymers and ionomer resins; epoxy resins, polyester, styrene-butadiene copolymers, polyvinylpyrrolidone, methyl vinyl ether-anhydrous maleic acid copolymers, maleic acid-modified phenolic resins, phenol-modified terpene resins, etc.

The toner of the present invention may include a fixing aid besides the binder resin, a colorant and a charge controlling agent. This is why the toner can be used in an oilless system having a fixing system not applying an oil on a fixing roller such that a toner does not adhere thereto. Specific examples of the fixing aid include, but are not limited to, polyolefin such as polyethylene and polypropylene, fatty acid metal salt, fatty acid ester, paraffin wax, amide wax, polyhydric wax, silicone varnish, carnauba wax and ester wax etc.

Specific examples of the colorants include known pigments and dyes capable of forming yellow, magenta, cyan and black toners. Specific examples of yellow pigment include, but are not limited to, cadmium yellow, mineral fast yellow, nickel titanium yellow, Naples yellow, naphthol yellow S, Hansa yellow G, Hansa yellow 10G, benzidine yellow GR, quinoline yellow lake, permanent yellow NCG and tartrazine lake.

Specific examples of orange pigments include, but are not limited to, molybdenum orange, permanent orange GTR, pyrazolone orange, Vulcan orange, indanthrene brilliant orange RK, benzidine orange G and indanthrene brilliant orange GK.

Specific examples of red pigments include, but are not limited to, iron red, cadmium red, permanent red 4R, lithol red, pyrazolone red, watching red calcium salt, lake red D, brilliant carmine 6B, eosin lake, rhodamine lake B, alizarin lake and brilliant carmine 3B.

Specific examples of violet pigments include, but are not limited to, fast violet B and methyl violet lake.

Specific examples of blue pigments include, but are not limited to, cobalt blue, alkali blue, Victoria blue lake, phthalocyanine blue, non-metal phthalocyanine blue, phthalocyanine blue-partly chloride, fast sky blue and indanthrene blue BC.

Specific examples of green pigments include, but are not limited to, chromium green, chromium oxide, pigment green B and malachite green lake.

Specific examples of black pigments include, but are not limited to, carbon black, oil furnace black, channel black, lamp black, acetylene black, an azine color such as aniline black, metal salt azo color, metal oxide, complex metal oxide.

These colorants can be used alone or in combination.

The toner for electrophotography may further include a charge controlling agent when necessary. The charge controlling agent is not particularly limited, and nigrosine; an azine dye having an alkyl group having 2 to 16 carbon atoms (see Japanese Examined Patent Publication No. 42-1627); a basic dye such as C.I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040) and C. I. Basic Green 4 (I. C. 42000); and a lake pigment of these basic dyes; a quaternary ammonium salt such as C. I. Solvent Black 8 (C. I. 26150), benzoylmethylhexadecylammonium chloride and decyltrimethyl chloride; a dialkyltin compound such as dibutyl and dioctyl; a dialkyltin borate compound; a guanidine derivative; a polyamine resin such as vinyl polymer having an amino group and condensation polymer having an amino group; a metal complex salt of monoazo dye described in Japanese Examined Patent Publication No. 41-20153, 43-27596, 44-6397 and 45-26478; salicylic acid described in Japanese Examined Patent Publication No. 55-42752 and 59-7385; a metal complex with Zn, Al, Co, Cr, Fe etc. of dialkylsalicylic acid, naphthoic acid and dicarboxylic acid; a sulfonated copper phthalocyanine pigment; organic boron acid slats; fluorine-containing quaternary ammonium salt; calixarene compound etc. can be used. For a color toner besides a black toner, a charge controlling agent impairing the original color should not be used, and white metallic salts of salicylic acid derivatives are preferably used.

Inorganic particulate materials such as silica, titanium oxide, alumina, silicon carbonate, silicon nitride and boron nitride; and particulate resins are externally added to mother toner particles to further improve transferability and durability thereof. This is because these external additives cover a release agent deteriorating the transferability and durability of a toner and the surface thereof to decrease contact area thereof. The inorganic particulate materials are preferably hydrophobized, and hydrophobized particulate metal oxides such as silica and titanium oxide are preferably used. The particulate resins such as polymethylmethacrylate and polystyrene fine particles having an average particle diameter of from 0.05 to 1 μm, which are formed by a soap-free emulsifying polymerization method, are preferably used. Further, a toner including the hydrophobized silica and hydrophobized titanium oxide as external additives, in which an amount of the hydrophobized silica is larger than that of the hydrophobized titanium oxide, has good charge stability against humidity. A toner including and external additives having a particle diameter larger than that of conventional external additives, such as a silica having a specific surface area of from 20 to 50 $m^2/g$ and particulate resins having an average particle diameter of from 1/100 to 1/8 to that of the toner besides the inorganic particulate materials, has good durability. This is because the external additives having a particle diameter larger than that of the particulate metal oxides prevent the particulate metal oxides from being buried in mother toner particles, although tending to be buried therein while the toner is mixed and stirred with a carrier, and charged in an image developer for development. A toner internally including the inorganic particulate materials and particulate resins improves pulverizability as well as transferability and durability although improving less than a toner externally including them. When the external and internal additives are used together, the burial of the external additives in mother toner particles can be prevented and the resultant toner stably has good transferability and durability.

Specific examples of the hydrophobizer include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxylsilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyltrichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminum coupling agents can be used. Besides, as an external additive for the purpose of improving cleanability, lubricants such as a particulate fatty acid metal salt and polyvinylidene fluoride can be used.

The toner of the present invention can be prepared by known methods such as a pulverization method and a polymerization method. In the pulverization method, as apparatuses for melting and kneading a toner, a batch type two-roll kneading machine, a Bumbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG are preferably used. The melted and kneaded materials thereby are cooled and pulverized. A hammer mill, rotoplex, etc. crush the cooled materials, and jet stream and mechanical pulverizers pulverize the crushed materials to preferably have an average particle diameter of from 3 to 15 μm. Further, the pulverized materials are classified into the materials having particle diameters of from 5 to 20 μm by a wind-force classifier, etc. Next, an external additive is preferably added to mother toner particles. The external additive and mother toner particles are mixed and stirred by a mixer such that the external additive covers the surface of the mother toner particles while pulverized. It is essential that the external additives such as inorganic particulate materials and particulate resins are uniformly and firmly fixed to the mother toner particles improve durability of the resultant toner. This is simply an example and the method is not limited thereto.

The carrier of the present invention is used in a supplementary developer composed of carrier and toner, and it is applied to an image forming apparatus for conducting image formation while an excess developer in an image developer is exhausted, thereby a stable image quality is obtained for a very long period of time. Namely, the deteriorated carrier inside the image developer and a carrier not deteriorated in a supplementary developer are interchanged to maintain the charging amount stably over a long time, so that a stable image is obtained. The present system is particularly effective in printing a large image area. In printing a large image area, charge deterioration of carrier due to spent toner to a carrier is a main part of carrier deterioration, by using the present system, in printing a large image area, since the amount of replenishing carrier becomes large, frequency of interchanging the deteriorated carrier increases. From this, a stable image is obtained over a very long period of time.

The mixing ratio of a supplementary developer is preferably set in such manner that a toner has a compounding ratio of 2 to 50 parts by weight relative to 1 part by weight of carrier. When the toner is less than 2 parts by weight, the amount of replenishing carrier is too much, leading to an excess supply of carrier, and carrier concentration in the image developer becomes too high, hence, the charging amount of developer tends to increase. Resulting from an increase in the charging amount of developer, development ability lowers and image concentration lowers. When more than 50 parts by weight, the ratio of carrier in a supplementary developer becomes small, hence, interchange of carrier in an image forming apparatus becomes small, and an effect on carrier deterioration cannot be expected.

In an image forming apparatus including a process cartridge including an image developer using the developer of the present invention, a photoreceptor is driven and rotated at a predetermined circumferential velocity, by a charger, the circumferential surface of photoreceptor is uniformly charged at a predetermined positive or negative potential. Next, from an exposure device (not shown in the figure) such as exposure device of slit exposure system and exposure device of scanning exposure by laser beam, exposure light is irradiated onto the circumferential surface of photoreceptor to form an electrostatic latent image sequentially. Further, the electrostatic latent image formed on the circumferential surface of photoreceptor is developed by an image developer using a developer of the present invention to form a toner image. Next, the toner image formed on the circumferential surface of photoreceptor is synchronized with the rotation of photoreceptor, and transferred sequentially to a transfer paper fed between the photoreceptor and a transfer device (not shown in the figure) from a paper feeding part (not shown in the figure). Further, the transfer paper that the toner image was transferred is separated from the circumferential surface of photoreceptor and introduced into a fixing device (not shown in the figure) and fixed, then, printed out to the outside of the image forming device as a copy. On the other hand, regarding the surface of photoreceptor after the toner image is transferred, the residual toner is removed for cleanup by a cleaner, then it is discharged by a discharging device (not shown in the figure) to use for image formation repeatedly.

Figure 3:
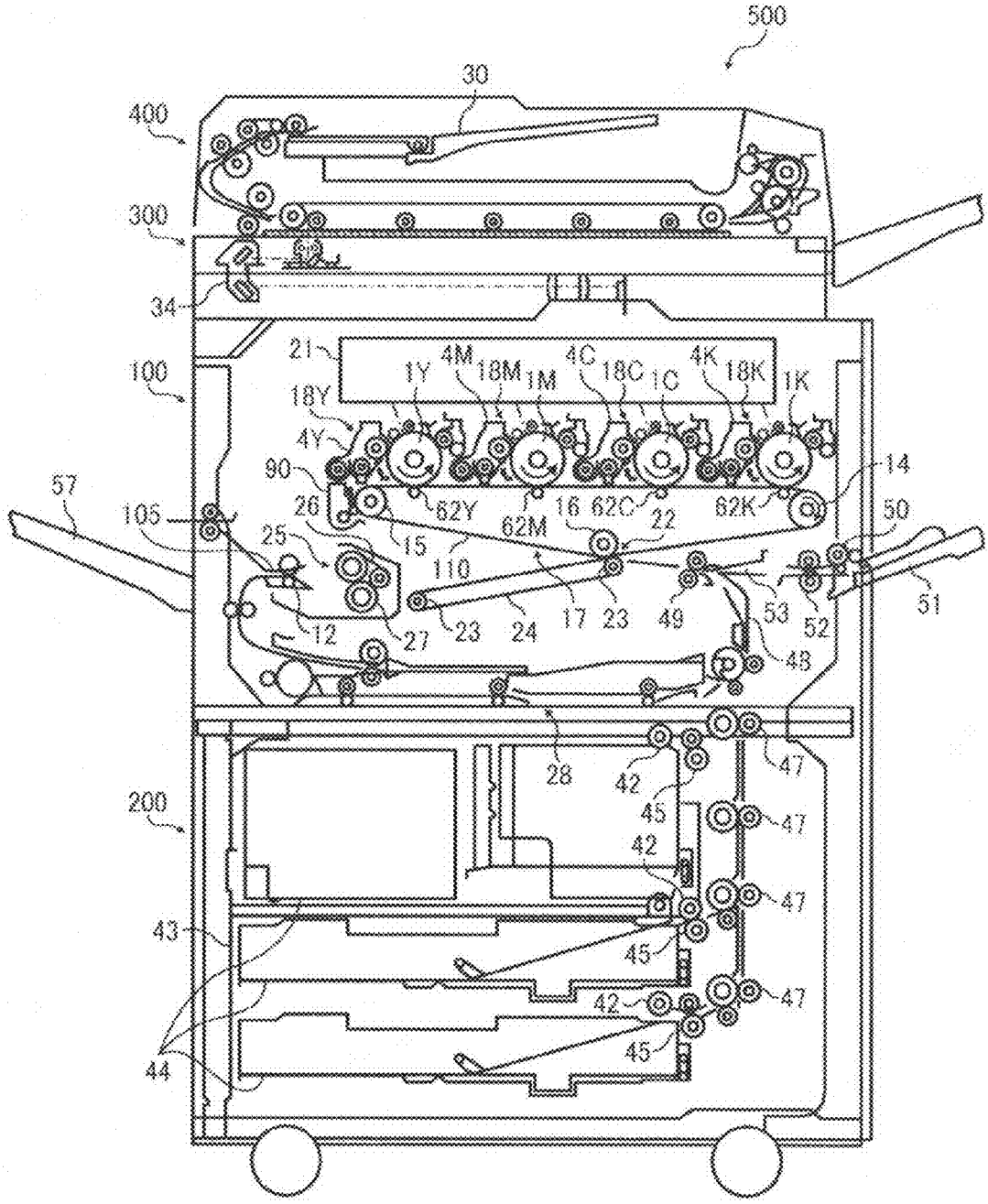
FIG. 3 is a schematic view illustrating an embodiment of the image forming apparatus of the present invention.

FIG. 3 is a schematic view illustrating an embodiment of the (full-color) image forming apparatus (500) of the present invention (hereinafter referred to as a copier). The copier (500) includes a printer (100), a paper feeder (200) and a scanner (300) fixed on the printer (100). Further, an automatic document feeder (400) is fixed on the scanner (300).

The printer (100) includes an image forming unit (20) formed of 4 process cartridges 18Y, 18M, 18C and 18K for forming yellow (Y), magenta (M), cyan (C) and black (K) color images, respectively.

Y, M, C and K represent yellow, magenta, cyan and black. The image forming apparatus includes an optical writing unit (21), an intermediate transfer unit (17), a second transferer (22), a pair of registration rollers (49), a fixer using belt fixing method (25), etc. besides the process cartridges 18Y, 18M, 18C and 18K.

The optical writing unit (21) includes a light source, a polygon mirror, a f-θ lens, a reflection mirror, etc., which are not illustrated, and irradiates the surface of the photoreceptor mentioned later with a laser beam, based on image data.

Each of the process cartridges 18Y, 18M, 18C and 18K include a drum-shaped photoreceptor (1), a charger, an image developer (4), a drum cleaner, a discharger, etc.

Figure 4:
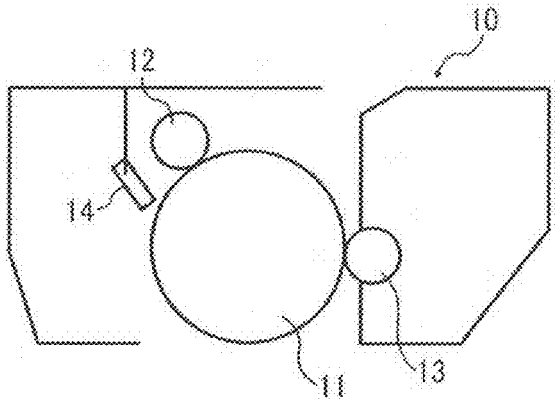
FIG. 4 is a schematic view illustrating an embodiment of the process cartridge of the present invention.

FIG. 4 is a schematic view illustrating an embodiment of the process cartridge of the present invention, including a photoreceptor, a charger, an image developer and a cleaner.

A process cartridge (10) is integrated by a photoreceptor, a charger (12) for charging the photoreceptor, an image developer (13) for forming a toner image by developing an electrostatic latent image formed on the photoreceptor using a developer of the present invention, and a cleaner (14) for removing the toner remaining on photoreceptor after transferring the toner image formed on the photoreceptor to a recording medium, and the process cartridge (10) is detachable from a main body of an image forming apparatus such as facsimile and printer.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

(Synthesis of Toner Binder)

Seven twenty four (724) parts of an adduct of bisphenol A with 2 moles of ethyleneoxide, 276 parts isophthalic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 32 parts of phthalic acid anhydride were added thereto and reacted for 2 hrs at 160° C. Next, the mixture was reacted with 188 parts of isophoronediisocyanate in ethyl acetate for 2 hrs at 80° C. to prepare a prepolymer including isocyanate (1). Next, 267 parts of the prepolymer (1) and 14 parts of isophoronediamine were mixed for 2 hrs at 50° C. to prepare a urea-modified polyester resin (1) having a weigh-average molecular weight of 64,000. Similarly, 724 parts of an adduct of bisphenol A with 2 moles of ethyleneoxide and 276 parts of terephthalic acid were polycondensed for 8 hrs at a normal pressure and 230° C., and further, after the mixture was depressurized by 10 to 15 mm Hg and reacted for 5 hrs to prepare a unmodified polyester resin (a) having a peak molecular weight of 5,000. Two hundred (200) parts of the urea-modified polyester (1) and 800 parts of the unmodified polyester resin (a) were dissolved and mixed in 2,000 parts of a mixed solvent formed of ethyl acetate and MEK (1/1) to prepare a toner binder (1) ethyl acetate/MEK solution. The toner binder resin (1) ethyl acetate/MEK solution was partially depressurized and dried to isolate the toner binder (1). The toner binder (1) had a glass transition temperature (Tg) of 62° C.

(Preparation of Toner)

Two forty (240) parts of the toner binder (1) ethyl acetate/MEK solution, 20 parts of pentaerythritoltetrabehenate having a melting point of 81° C. and a melting viscosity of 25 cps and 4 parts of C.I. Pigment Yellow 154 were uniformly dissolved and dispersed with TK-HOMOMIXER at 12,000 rpm and 60° C. in a beaker to prepare a toner constituents solution. Seven hundred and six (706) parts of ion-exchanged water, 294 parts of hydroxyapatite suspension liquid having a concentration of 10% (Supertite 10 from Nippon Chemical Industrial Co., Ltd.) and 0.2 parts of sodium dodecylbenzenesulfonate were uniformly dissolved in a beaker to prepare a solution. The solution was heated to have a temperature of 60° C. and the toner constituents liquid was put therein while stirred with TK-HOMOMIXER at 12,000 rpm for 10 min to prepare a liquid mixture. The liquid mixture was placed in a flask having a stirrer and a thermometer and heated to have a temperature of 98° C., and a solvent was removed therefrom to prepare a dispersion slurry. The dispersion slurry was depressurized and filtered to prepare a filtered cake.

(Washing, Drying and Fluorinating)

1: 100 parts of ion-exchanged water were added to the filtered cake, which was mixed with TK-HOMOMIXER at 12,000 rpm for 10 min and filtered.

2: 100 parts of sodium hydroxide solution having a concentration of 10% were added to the filtered cake of 1, which was mixed with TK-HOMOMIXER at 12,000 rpm for 30 min and filtered under reduced pressure.

3: 100 parts of hydrochloric acid having a concentration of 10% were added to the filtered cake of 2, which was mixed with TK-HOMOMIXER at 12,000 rpm for 30 min and filtered.

4: 300 parts of ion-exchanged water were added to the filtered cake of 3, which was mixed with TK-HOMOMIXER at 12,000 rpm for 10 min and filtered twice to prepare a [filtered cake 1].

The [filtered cake 1] was dried by an air drier at 45° C. for 48 hrs.

15 parts of the [filtered cake 1] were added to 90 parts of water, in which 0.0005 parts of a fluorine compound were dispersed so as to adhere to the surface of toner particles. Next, the filtered cake the fluorine compound adheres on was dried by an air drier at 45° C. for 48 hrs, and sieved with a mesh having an opening of 75 μm to prepare [mother toner particles 1].

As external additives, 1.5 parts of hydrophobic silica and 0.7 parts of hydrophobized titanium oxide were mixed with 100 parts of the [mother toner particles 1] by HENSCHEL MIXER at 2,000 rpm for 30 sec 5 times to prepare a toner 1.

<Synthesis of Copolymer>

Three hundred (300) g of toluene were placed in a flask including a stirrer, and heated to have a temperature of 90° C. under nitrogen stream. Next, a mixture of 84.4 g (200 mmol) of 3-methacryloxypropyltris(trimethylsiloxy)silane having a formula of $CH_2{=}CMe\text{-}COO{-}C_3H_6{-}Si(OSiMe_3)_3$ (Me is a methyl group) (A component) Silaplane TM-0701T (manufactured by Chisso Corporation), 39 g (150 mmol) of 3-methacryloxypropyltrimethoxysilane (B component), 65.0 g (650 mmol) of methylmethacrylate (C component) and 0.58 g (3 mmol) of 2,2'-azobis-2-methylbutyronitrile was dropped therein for 1 hour. Further, a solution that 0.06 g (0.3 mmol) of 2,2'-azobis-2-methylbutyronitrile was dissolved in 15 g of toluene was added, then, mixed at 90 to 100° C. for 3 hours such that radical copolymerization is performed to prepare a methacrylic copolymer 1. The methacrylic copolymer 1 had a weight-average molecular weight of 33,000. A solution of the methacrylic copolymer 1 was diluted with toluene to have a nonvolatile component of 25% by weight. The copolymer solution had a viscosity of 8.8 $mm^2$/sec and a specific gravity of 0.91.

The weight-average molecular weight was determined from standard polyester conversion using gel permeation chromatography. The viscosity was measured according to JIS-K-2283.

The nonvolatile component was determined by the following formula, weighing 1 g of the coating composition on an aluminum plate and heating the composition at 150° C. for 1 hr.

Nonvolatile component (%)=(weight before heated−weight after heated)×100/weight before heated (Preparation of Carrier Core Material)

<Core Material Preparation Method 1>

A mixed powder including a $MnCO_3$ powder, a $Mg(OH)_2$ powder and a $SrCO_3$ powder was preliminarily fired in a heating furnace at 850° C. for 1 hr in the atmosphere, and the burned powder was cooled and pulverized to prepare a powder having a particle diameter not greater than 3 μm.

A dispersant in an amount of 1% by weight was added to the powder together with water to prepare a slurry, and the slurry was granulated by a spray drier to prepare a granulated material having an average particle diameter about 40 μm.

The granulated material was placed in a firing furnace and fired at 1,120° C. for 4 hrs in a nitrogen atmosphere. The fired material was pulverized by a pulverizer and sieved to a spherical particulate ferrite 1 having a volume-average particle diameter about 35 μm.

The spherical particulate ferrite 1 includes MnO, MgO, $Fe_2O_3$ and SrO in amounts of 38%, 12%, 51% and 0.5% by mol, respectively.

The spherical particulate ferrite 1 had a SF-1 of 144 and SF-2 of 156.

<Core Material Preparation Method 2>

The procedure for preparation of the core material in Core Material Preparation Method 1 was repeated except for firing the granulated material at 1,180° C. to prepare a spherical particulate ferrite 2 having a volume-average particle diameter about 35 μm.

The spherical particulate ferrite 2 had a SF-1 of 137 and SF-2 of 133.

<Core Material Preparation Method 3>

A mixed powder including a $MnCO_3$ powder, a $Mg(OH)_2$ powder and a $Fe_2O_3$ powder was preliminarily fired in a heating furnace at 900° C. for 3 hrs in the atmosphere, and the burned powder was cooled and pulverized to prepare a powder having a particle diameter about 8 μm.

A dispersant in an amount of 1% by weight was added to the powder together with water to prepare a slurry, and the slurry was granulated by a spray drier to prepare a granulated material having an average particle diameter about 40 μm.

The granulated material was placed in a firing furnace and fired at 1,300° C. for 5 hrs in a nitrogen atmosphere. The fired material was pulverized by a pulverizer and sieved to a spherical particulate ferrite 3 having a volume-average particle diameter about 35 μm.

The spherical particulate ferrite 1 includes MnO, MgO and $Fe_2O_3$ in amounts of 45.6%, 0.6% and 53.7% by mol, respectively.

The spherical particulate ferrite 3 had a SF-1 of 141 and SF-2 of 148.

<Core Material Preparation Method 4>

A mixed powder including a $MnCO_3$ powder, a $Mg(OH)_2$ powder and a $Fe_2O_3$ powder was preliminarily fired in a heating furnace at 900° C. for 3 hrs in the atmosphere, and the burned powder was cooled and pulverized to prepare a powder having a particle diameter about 1 μm.

Then, The procedure for preparation of the core material in Core Material Preparation Method 1 was repeated to prepare a spherical particulate ferrite 4.

The spherical particulate ferrite 4 had a SF-1 of 129 and SF-2 of 128.

<Core Material Preparation Method 5>

The procedure for preparation of the core material in Core Material Preparation Method 1 was repeated except for firing the granulated material at 1,040° C. to prepare a spherical particulate ferrite 5 having a volume-average particle diameter about 35 μm.

The spherical particulate ferrite 2 had a SF-1 of 153 and SF-2 of 171.

Example 1

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Methacrylic copolymer 1 (including a solid content of 100% by weight) | 18.0 |
| Silicone resin solution (SR2410 including a solid content of 20% by weight from Dow Corning Toray Silicone Co., Ltd.) | 360.0 |
| Aminosilane (SH6020 including a solid content of 100% by weight from Dow Corning Toray Silicone Co., Ltd.) | 4.0 |
| Electroconductive particulate material ($Al_2O_3$ doped with $In_2O_3$/Sn: EC-700 from Titan Kogyo Co., Ltd., having a particle diameter of 0.35 μm) | 180 |
| Toluene | 900 |

On 5,000 parts by weight of the spherical particulate fennel, a solution including the resin-coated layer forming solution and an additional 10.5 parts of titanium diisopropoxybis (ethylacetoacetate) (TC-750 from Matsumoto Fine Chemical Co., Ltd.) was coated by SPIRA COTA (from Okada Seiko Co., Ltd.) at a an inner temperature of 70° C. and dried. The resultant carrier was burned in an electric oven at 210° C. for 1 hr. After cooled, the ferrite powder bulk was sieved through openings of 63 μm to prepare a [carrier 1].

Ninety three (93) parts of the [carrier 1] and 7 parts of the [toner 1] were mixed to prepare a developer to be evaluated. The properties of the carrier and the evaluation results are shown in Tables 1 and 2, respectively.

Example 2

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Methacrylic copolymer 1 (including a solid content of 100% by weight) | 30.0 |
| Silicone resin solution (SR2410 including a solid content of 20% by weight from Dow Corning Toray Silicone Co., Ltd.) | 600.0 |
| Aminosilane (SH6020 including a solid content of 100% by weight from Dow Corning Toray Silicone Co., Ltd.) | 6.7 |
| Electroconductive particulate material (EC-700 from Titan Kogyo Co., Ltd., having a particle diameter of 0.35 μm) | 300 |
| Toluene | 1,500 |

On 5,000 parts by weight of the spherical particulate ferritel, a solution including the resin-coated layer forming solution and an additional 17.5 parts of titanium diisopropoxybis (ethylacetoacetate) (TC-750 from Matsumoto Fine Chemical Co., Ltd.) was coated by SPIRA COTA (from Okada Seiko Co., Ltd.) at a an inner temperature of 70° C. and dried. The resultant carrier was burned in an electric oven at 210° C. for 1 hr. After cooled, the ferrite powder bulk was sieved through openings of 63 μm to prepare a [carrier 2].

Ninety three (93) parts of the [carrier 2] and 7 parts of the [toner 1] were mixed to prepare a developer to be evaluated.

Example 3

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Methacrylic copolymer 1 (including a solid content of 100% by weight) | 12.0 |
| Silicone resin solution (SR2410 including a solid content of 20% by weight from Dow Corning Toray Silicone Co., Ltd.) | 240.0 |
| Aminosilane (SH6020 including a solid content of 100% by weight from Dow Corning Toray Silicone Co., Ltd.) | 2.7 |
| Electroconductive particulate material (EC-700 from Titan Kogyo Co., Ltd., having a particle diameter of 0.35 μm) | 120 |
| Toluene | 600 |

On 5,000 parts by weight of the spherical particulate ferritel, a solution including the resin-coated layer forming solution and an additional 7.0 parts of titanium diisopropoxybis (ethylacetoacetate) (TC-750 from Matsumoto Fine Chemical Co., Ltd.) was coated by SPIRA COTA (from Okada Seiko Co., Ltd.) at a an inner temperature of 70° C. and dried. The resultant carrier was burned in an electric oven at 210° C. for 1 hr. After cooled, the ferrite powder bulk was sieved through openings of 63 μm to prepare a [carrier 3].

Ninety three (93) parts of the [carrier 3] and 7 parts of the [toner 1] were mixed to prepare a developer to be evaluated.

Example 4

The procedure for preparation of the [carrier 1] in Example 1 was repeated except for replacing the spherical particulate ferrite 1 with the spherical particulate ferrite 2 to prepare a [carrier 4].

Ninety three (93) parts of the [carrier 4] and 7 parts of the [toner 1] were mixed to prepare a developer to be evaluated.

Example 5

The procedure for preparation of the [carrier 1] in Example 1 was repeated except for replacing the spherical particulate ferrite 1 with the spherical particulate ferrite 3 to prepare a [carrier 5].

Ninety three (93) parts of the [carrier 5] and 7 parts of the [toner 1] were mixed to prepare a developer to be evaluated.

Example 6

The procedure for preparation of the [carrier 1] in Example 1 was repeated except for changing 180 parts to 450 parts by weight of EC-700 to prepare a [carrier 6].

Ninety three (93) parts of the [carrier 6] and 7 parts of the [toner 1] were mixed to prepare a developer to be evaluated.

Example 7

The procedure for preparation of the [carrier 1] in Example 1 was repeated except for changing 180 parts to 270 parts by weight of EC-700 to prepare a [carrier 7].

Ninety three (93) parts of the [carrier 7] and 7 parts of the [toner 1] were mixed to prepare a developer to be evaluated.

Example 8

The procedure for preparation of the [carrier 1] in Example 1 was repeated except for changing 180 parts to 90 parts by weight of EC-700 to prepare a [carrier 8].

Ninety three (93) parts of the [carrier 8] and 7 parts of the [toner 1] were mixed to prepare a developer to be evaluated.

Example 9

The procedure for preparation of the [carrier 1] in Example 1 was repeated except for replacing EC-700 with aluminum oxide AA-03 from Sumitomo Chemical Co., Ltd. to prepare a [carrier 9].

Ninety three (93) parts of the [carrier 9] and 7 parts of the [toner 1] were mixed to prepare a developer to be evaluated.

Example 10

The procedure for preparation of the [carrier 1] in Example 1 was repeated except for replacing EC-700 with a barium sulfate powder coated with oxygen-deficient tin oxide (Passtran 4310 from Mitsui Mining & Smelting Co., Ltd.) to prepare a [carrier 10].

Ninety three (93) parts of the [carrier 10] and 7 parts of the [toner 1] were mixed to prepare a developer to be evaluated.

Example 11

The procedure for preparation of the [carrier 1] in Example 1 was repeated except for enlarging the particle diameter of EC-700 from 350 nm to 700 nm to prepare a [carrier 11].

Ninety three (93) parts of the [carrier 11] and 7 parts of the [toner 1] were mixed to prepare a developer to be evaluated.

Example 12

The procedure for preparation of the [carrier 1] in Example 1 was repeated except for enlarging the particle diameter of EC-700 from 350 nm to 800 nm to prepare a [carrier 12].

Ninety three (93) parts of the [carrier 12] and 7 parts of the [toner 1] were mixed to prepare a developer to be evaluated.

Example 13

The procedure for preparation of the [carrier 1] in Example 1 was repeated except for replacing EC-700 with a tin compound S-2000 (from Mitsubishi Materials Electronic Chemicals Co., Ltd.) to prepare a [carrier 13].

Ninety three (93) parts of the [carrier 13] and 7 parts of the [toner 1] were mixed to prepare a developer to be evaluated.

Example 14

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Silicone resin solution<br>(SR2410 including a solid content of 20% by weight from Dow Corning Toray Silicone Co., Ltd.) | 450.0 |
| Aminosilane<br>(SH6020 including a solid content of 100% by weight from Dow Corning Toray Silicone Co., Ltd.) | 4.0 |
| Electroconductive particulate material<br>(EC-700 from Titan Kogyo Co., Ltd., having a particle diameter of 0.35 μm) | 180 |
| Toluene | 900 |

On 5,000 parts by weight of the spherical particulate ferritel, a solution including the resin-coated layer forming solution and an additional 10.5 parts of titanium diisopropoxybis (ethylacetoacetate) (TC-750 from Matsumoto Fine Chemical Co., Ltd.) was coated by SPIRA COTA (from Okada Seiko Co., Ltd.) at a an inner temperature of 70° C. and dried. The resultant carrier was burned in an electric oven at 210° C. for 1 hr. After cooled, the ferrite powder bulk was sieved through openings of 63 μm to prepare a [carrier 14].

Ninety three (93) parts of the [carrier 14] and 7 parts of the [toner 1] were mixed to prepare a developer to be evaluated.

Example 15

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Methacrylic copolymer 1<br>(including a solid content of 100% by weight) | 90.0 |
| Aminosilane<br>(SH6020 including a solid content of 100% by weight from Dow Corning Toray Silicone Co., Ltd.) | 4.0 |
| Electroconductive particulate material<br>(EC-700 from Titan Kogyo Co., Ltd., having a particle diameter of 0.35 μm) | 180 |
| Toluene | 900 |

On 5,000 parts by weight of the spherical particulate ferrite 1, a solution including the resin-coated layer forming solution and an additional 10.5 parts of titanium diisopropoxybis (ethylacetoacetate) (TC-750 from Matsumoto Fine Chemical Co., Ltd.) was coated by SPIRA COTA (from Okada Seiko Co., Ltd.) at a an inner temperature of 70° C. and dried. The resultant carrier was burned in an electric oven at 210° C. for 1 hr. After cooled, the ferrite powder bulk was sieved through openings of 63 μm to prepare a [carrier 15].

Ninety three (93) parts of the [carrier 15] and 7 parts of the [toner 1] were mixed to prepare a developer to be evaluated.

Example 16

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Methacrylic copolymer 1<br>(including a solid content of 100% by weight) | 12.0 |
| Silicone resin solution<br>(SR2410 including a solid content of 20% by weight from Dow Corning Toray Silicone Co., Ltd.) | 240.0 |
| Aminosilane<br>(SH6020 including a solid content of 100% by weight from Dow Corning Toray Silicone Co., Ltd.) | 2.7 |
| Electroconductive particulate material<br>(EC-700 from Titan Kogyo Co., Ltd., having a particle diameter of 0.35 μm) | 300 |
| Toluene | 600 |

On 5,000 parts by weight of the spherical particulate ferrite1, a solution including the resin-coated layer forming solution and an additional 7.0 parts of titanium diisopropoxybis(ethylacetoacetate) (TC-750 from Matsumoto Fine Chemical Co., Ltd.) was coated by SPIRA COTA (from Okada Seiko Co., Ltd.) at a an inner temperature of 70° C. and dried. The resultant carrier was burned in an electric oven at 210° C. for 1 hr. After cooled, the ferrite powder bulk was sieved through openings of 63 μm to prepare a [carrier 16].

Ninety three (93) parts of the [carrier 16] and 7 parts of the [toner 1] were mixed to prepare a developer to be evaluated.

Comparative Example 1

The procedure for preparation of the [carrier 1] in Example 1 was repeated except for replacing the spherical particulate ferrite 1 with the spherical particulate ferrite 4 to prepare a [carrier 17].

Ninety three (93) parts of the [carrier 17] and 7 parts of the [toner 1] were mixed to prepare a developer to be evaluated.

Comparative Example 2

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Methacrylic copolymer 1 (including a solid content of 100% by weight) | 36.0 |
| Silicone resin solution (SR2410 including a solid content of 20% by weight from Dow Corning Toray Silicone Co., Ltd.) | 720.0 |
| Aminosilane (SH6020 including a solid content of 100% by weight from Dow Corning Toray Silicone Co., Ltd.) | 8.0 |
| Electroconductive particulate material (EC-700 from Titan Kogyo Co., Ltd., having a particle diameter of 0.35 μm) | 360 |
| Toluene | 1,800 |

On 5,000 parts by weight of the spherical particulate ferritel, a solution including the resin-coated layer forming solution and an additional 21.0 parts of titanium diisopropoxybis (ethylacetoacetate) (TC-750 from Matsumoto Fine Chemical Co., Ltd.) was coated by SPIRA COTA (from Okada Seiko Co., Ltd.) at a an inner temperature of 70° C. and dried. The resultant carrier was burned in an electric oven at 210° C. for 1 hr. After cooled, the ferrite powder bulk was sieved through openings of 63 μm to prepare a [carrier 18].

Ninety three (93) parts of the [carrier 18] and 7 parts of the [toner 1] were mixed to prepare a developer to be evaluated.

Comparative Example 3

The following coated layer forming materials were dispersed by a paint shaker for 1 hr together with 1,000 parts of 0.5 mm Zr beads, and the beads were removed by a mesh to prepare a resin-coated layer forming solution.

| | |
|---|---|
| Methacrylic copolymer 1 (including a solid content of 100% by weight) | 6.0 |
| Silicone resin solution (SR2410 including a solid content of 20% by weight from Dow Corning Toray Silicone Co., Ltd.) | 120.0 |
| Aminosilane (SH6020 including a solid content of 100% by weight from Dow Corning Toray Silicone Co., Ltd.) | 1.3 |
| Electroconductive particulate material (EC-700 from Titan Kogyo Co., Ltd., having a particle diameter of 0.35 μm) | 60 |
| Toluene | 300 |

On 5,000 parts by weight of the spherical particulate ferritel, a solution including the resin-coated layer forming solution and an additional 3.5 parts of titanium diisopropoxybis (ethylacetoacetate) (TC-750 from Matsumoto Fine Chemical Co., Ltd.) was coated by SPIRA COTA (from Okada Seiko Co., Ltd.) at a an inner temperature of 70° C. and dried. The resultant carrier was burned in an electric oven at 210° C. for 1 hr. After cooled, the ferrite powder bulk was sieved through openings of 63 μm to prepare a [carrier 19].

Ninety three (93) parts of the [carrier 19] and 7 parts of the [toner 1] were mixed to prepare a developer to be evaluated.

Comparative Example 4

The procedure for preparation of the [carrier 1] in Example 1 was repeated except for replacing the spherical particulate ferrite 1 with the spherical particulate ferrite 5 to prepare a [carrier 20].

Ninety three (93) parts of the [carrier 20] and 7 parts of the [toner 1] were mixed to prepare a developer to be evaluated.

Comparative Example 5

The procedure for preparation of the [carrier 1] in Example 1 was repeated except for changing 180 parts to 495 parts by weight of EC-700 to prepare a [carrier 21].

Ninety three (93) parts of the [carrier 21] and 7 parts of the [toner 1] were mixed to prepare a developer to be evaluated.

Comparative Example 6

The procedure for preparation of the [carrier 1] in Example 1 was repeated except for changing 180 parts to 45 parts by weight of EC-700 to prepare a [carrier 22].

Ninety three (93) parts of the [carrier 22] and 7 parts of the [toner 1] were mixed to prepare a developer to be evaluated.

TABLE 1

| | Carrier | A | B | C | D | E | F | G |
|---|---|---|---|---|---|---|---|---|
| Example 1 | 1 | 1.5 | 0.01 | 200 | 350 | 0.6 | 35.8 | 10.7 |
| Example 2 | 2 | 0.1 | 0.01 | 200 | 350 | 0.6 | 36 | 11.8 |
| Example 3 | 3 | 4.9 | 0.02 | 200 | 350 | 0.6 | 35.8 | 10.3 |
| Example 4 | 4 | 2.8 | 0.03 | 200 | 350 | 0.6 | 35.7 | 11.1 |
| Example 5 | 5 | 2 | 0.01 | 200 | 350 | 0.6 | 36.1 | 11.4 |
| Example 6 | 6 | 0.6 | 0.01 | 500 | 350 | 0.6 | 35.9 | 8.4 |
| Example 7 | 7 | 1.3 | 0.01 | 300 | 350 | 0.6 | 35.8 | 9.9 |
| Example 8 | 8 | 2.3 | 0.02 | 100 | 350 | 0.6 | 35.8 | 12.1 |
| Example 9 | 9 | 1.7 | 0.01 | 200 | 400 | 4.9 | 35.8 | 15.8 |
| Example 10 | 10 | 0.9 | 0.01 | 200 | 100 | 1.9 | 35.7 | 11.1 |
| Example 11 | 11 | 2.8 | 0.02 | 200 | 700 | 1.2 | 36 | 11.7 |
| Example 12 | 12 | 3.2 | 0.02 | 200 | 800 | 1.3 | 35.9 | 11.8 |
| Example 13 | 13 | 0.5 | 0.01 | 200 | 30 | 2 | 35.7 | 10.6 |
| Example 14 | 14 | 1.9 | 0.01 | 200 | 350 | 0.6 | 35.9 | 10.9 |
| Example 15 | 15 | 1.4 | 0.01 | 200 | 350 | 0.6 | 35.8 | 10.5 |
| Example 16 | 16 | 3.9 | 0.02 | 500 | 350 | 0.6 | 35.7 | 7.6 |
| Comparative Example 1 | 17 | 0 | 0 | 200 | 350 | 0.6 | 35.9 | 11.9 |
| Comparative Example 2 | 18 | 0 | 0 | 200 | 350 | 0.6 | 36.1 | 12.2 |
| Comparative Example 3 | 19 | 5.6 | 0.03 | 200 | 350 | 0.6 | 35.7 | 9.5 |
| Comparative Example 4 | 20 | 3.7 | 0.05 | 200 | 350 | 0.6 | 35.4 | 10.4 |
| Comparative Example 5 | 21 | 0.5 | 0.01 | 550 | 350 | 0.6 | 35.9 | 7.9 |
| Comparative Example 6 | 22 | 2.6 | 0.02 | 50 | 350 | 0.6 | 35.8 | 13.3 |

A: Areal ratio of exposed core material (%)
B: Ratio of the largest exposed area (%)
C: Content of particulate material per 100 parts by weight of a resin (parts by weight)
D: Particle diameter of electroconductive particulate material (nm)
E: Powder specific resistivity of electroconductive particulate material (LogΩ · cm)
F: Weight-average particle diameter (μm)
G: Carrier resistivity (LogΩ · cm)

TABLE 2

| | Ghost Image | | | | Durability | | |
|---|---|---|---|---|---|---|---|
| | After 50,000 ΔID | After 50,000 evaluation | After 500,000 ΔID | After 500,000 evaluation | After 800,000 resistivity | Resistivity difference | Evaluation |
| Example 1 | 0.00 | Excellent | 0.01 | Excellent | 10.30 | 0.40 | Excellent |
| Example 2 | 0.01 | Excellent | 0.01 | Excellent | 11.90 | −0.10 | Excellent |
| Example 3 | 0.01 | Excellent | 0.04 | Acceptable | 9.30 | 1.00 | Good |
| Example 4 | 0.01 | Excellent | 0.03 | Good | 10.40 | 0.70 | Good |
| Example 5 | 0.01 | Excellent | 0.02 | Good | 10.50 | 0.90 | Good |
| Example 6 | 0.00 | Excellent | 0.05 | Acceptable | 10.10 | −1.70 | Acceptable |
| Example 7 | 0.01 | Excellent | 0.03 | Good | 10.50 | −0.80 | Good |
| Example 8 | 0.02 | Good | 0.03 | Good | 10.70 | 1.40 | Acceptable |
| Example 9 | 0.05 | Acceptable | 0.04 | Acceptable | 15.60 | 0.20 | Excellent |
| Example 10 | 0.01 | Excellent | 0.02 | Good | 11.20 | −0.10 | Excellent |
| Example 11 | 0.01 | Excellent | 0.03 | Good | 11.00 | 0.70 | Good |
| Exaruple 12 | 0.02 | Good | 0.04 | Acceptable | 10.70 | 1.10 | Acceptable |
| Example 13 | 0.02 | Good | 0.05 | Acceptable | 11.40 | −0.80 | Good |
| Example 14 | 0.01 | Excellent | 0.02 | Good | 9.80 | 1.10 | Acceptable |
| Example 15 | 0.01 | Excellent | 0.04 | Acceptable | 11.60 | −1.10 | Acceptable |
| Example 16 | 0.01 | Excellent | 0.05 | Acceptable | 7.20 | 0.40 | Good |
| Comparative Example 1 | 0.08 | Unusable | 0.08 | Unusable | 12.20 | −0.30 | Excellent |
| Comparative Example 2 | 0.06 | Unusable | 0.08 | Unusable | 12.70 | −0.50 | Excellent |
| Comparative Example 3 | 0.04 | Acceptable | 0.07 | Unusable | 7.20 | 2.30 | Unusable |
| Comparative Example 4 | 0.05 | Acceptable | 0.06 | Unusable | 8.00 | 2.40 | Unusable |
| Comparative Example 5 | 0.01 | Excellent | 0.07 | Unusable | 10.90 | −3.00 | Unusable |
| Comparative Example 6 | 0.06 | Unusable | 0.08 | Unusable | 10.40 | 2.90 | Unusable |

(Developer Evaluation)

<Ghost Image>

Figure 5:
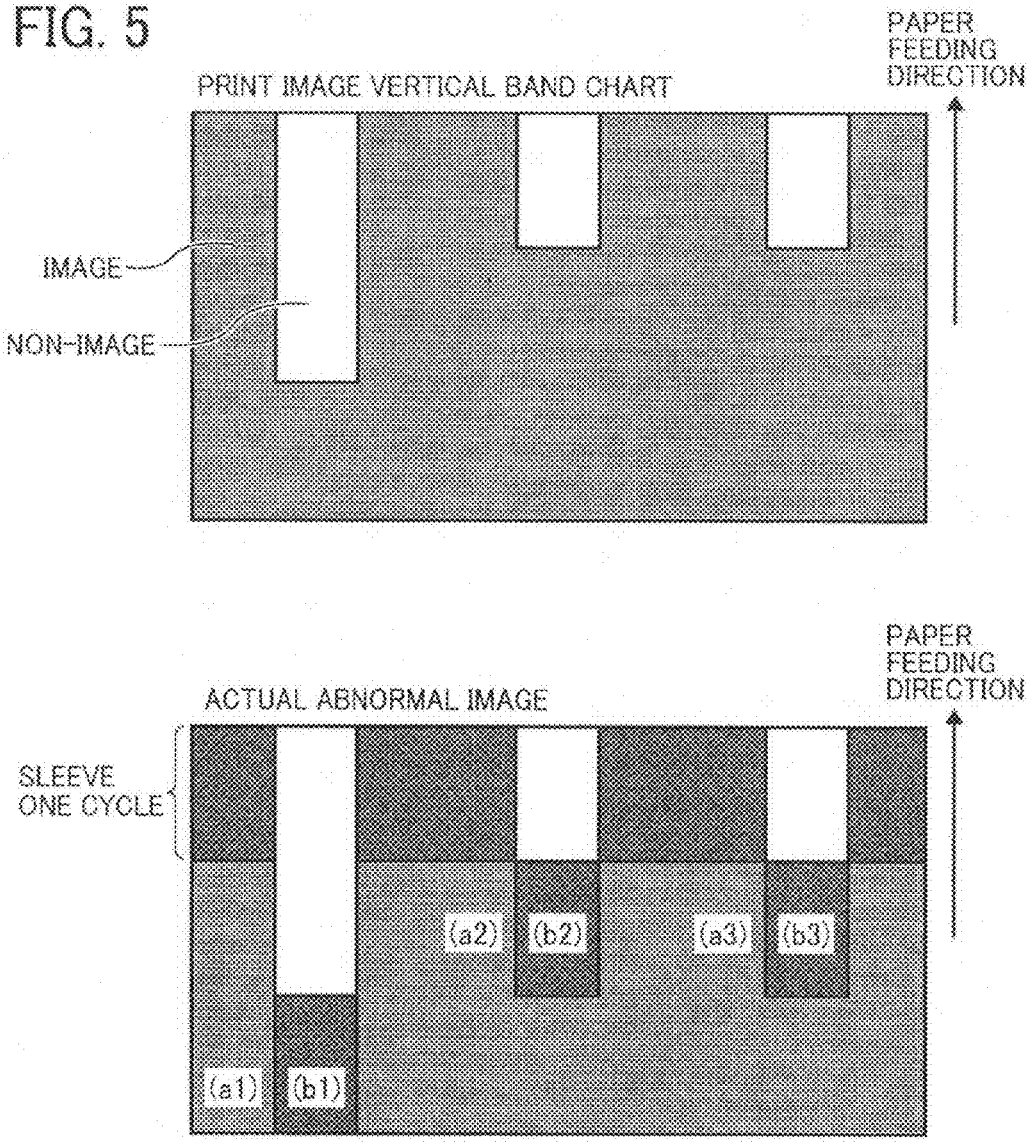
FIG. 5 illustrates a vertical band chart for evaluating a ghost image.

Each of the developers prepared in Examples 1 to 16 and Comparative Examples 1 to 6 was set in a marketed digital full-color printer RICOH Pro C901 from Ricoh Company, Ltd. After 50,000 and 500,000 images of A4 size image chart having an image area ratio of 8% were produced, a vertical band chart in FIG. 5 was printed to measure a difference of density between one cycle (a) and after one cycle (b) of sleeve and by X-Rite 938 from X-Rite, Inc. An average density among the center, rear and front was ΔID.

Excellent: 0.01≥ΔID

Good: 0.01<ΔID≤0.03

Acceptable: 0.03<ΔID≤0.06

Unusable: 0.06<ΔID

<Durability>

Each of the developers prepared in Examples 1 to 16 and Comparative Examples 1 to 6 was set in a marketed digital full-color printer RICOH Pro C901 from Ricoh Company, Ltd. to produce 800,000 images of A4 size image chart having an image area ratio of 8%. Before and after 800,000 images produced, the carrier resistivities were measured to determine a difference therebetween.

Excellent: Difference≤0.5

Good: 0.5<Difference≤1.0

Acceptable: 1.0<Difference≤2.0

Unusable: 2.0<Difference

Having now fully described the invention, it will be apparent to one of ordinary skill in the art that many changes and modifications can be made thereto without departing from the spirit and scope of the invention as set forth therein.

What is claimed is:

1. A carrier for developing electrostatic latent image, comprising:

a core material; and a coated layer covering the core material, comprising a binder resin and a particulate material, wherein the core material is exposed on the surface of the carrier at an areal ratio of from 0.1 to 1.9% and has the largest exposed part having an areal ratio not greater than 0.03%, and wherein the coated layer comprises the particulate material in an amount of from 100 to 500 parts by weight per 100 parts by weight of the binder resin.

2. The carrier of claim 1, wherein the particulate material is an electroconductive particulate material.

3. The carrier of claim 2, wherein the electroconductive particulate material has a volume-average particle diameter of from 100 to 700 nm.

4. The carrier of claim 2, wherein the electroconductive particulate material has a powder resistivity not greater than 2 Log Ω·cm.

5. The carrier of claim 1, wherein a SF-2 value of the core material is greater than a SF-1 value thereof.

6. The carrier of claim 1, wherein the binder resin comprises a silicone resin.

7. The carrier of claim 1, wherein the coated layer comprises a resin obtained by heating a copolymer including an A site from a monomer A component and a B site from a monomer B component having the following formulae (1) and (2), respectively:

(1)

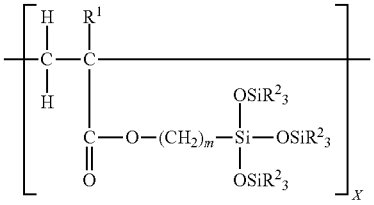

A site (from monomer A component)

-continued (2)

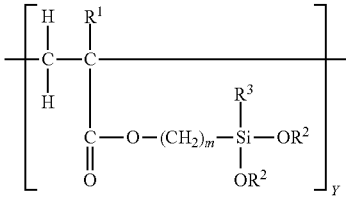

B site (from monomer B component)

wherein $R^1$ represents a hydrogen atom or a methyl group; m represents an alkylene group having 1 to 8 carbon atoms; $R^2$ represents an alkyl group having 1 to 4 carbon atoms; $R^3$ represents an alkyl group having 1 to 8 carbon atoms or an alkoxy group having 1 to 4 carbon atoms; X represents 10 to 90% by mol; and Y represents 10 to 90% by mol.

8. The carrier of claim 1, wherein the carrier has a weight-average particle diameter of from 20 to 65 μm.

9. The carrier of claim 1, wherein the carrier has a specific volume resistivity of from $1 \times 10^8$ to $1 \times 10^{15}$ μ·cm.

10. A developer for developing electrostatic latent image, comprising:

carrier according to claim 1; and a toner.

11. The carrier of claim 1, wherein the core material has a shape factor SF-1 of from 130 to 150 and a shape factor SF-2 of from 130 to 160.

* * * * *